United States Patent [19]

Tyree, Jr. et al.

[11] Patent Number: 4,888,955

[45] Date of Patent: Dec. 26, 1989

[54] TWO PHASE $CO_2$ STORAGE TANK

[75] Inventors: Lewis Tyree, Jr., Lexington, Va.; Roger F. Gyger, Naperville; George D. Rhoades, La Grange, both of Ill.

[73] Assignee: Liquid Carbonic Corporation, Chicago, Ill.

[21] Appl. No.: 235,298

[22] Filed: Aug. 23, 1988

[51] Int. Cl.[4] ..... F17C 5/02

[52] U.S. Cl. ..... 62/47.1; 62/384

[58] Field of Search ..... 62/52, 54, 384

[56] References Cited

U.S. PATENT DOCUMENTS

| | | | |
|---|---|---|---|
| 3,150,495 | 9/1964 | Reed | 62/54 |
| 3,191,395 | 6/1965 | Maher et al. | 62/52 |
| 3,195,316 | 7/1965 | Maher et al. | 62/52 |
| 3,303,660 | 2/1967 | Berg | 62/54 |
| 3,800,550 | 4/1974 | Delahunty | 62/54 |
| 3,812,683 | 5/1974 | Laverman | 62/54 |
| 4,137,723 | 2/1979 | Tyree, Jr. | 62/384 |
| 4,315,404 | 2/1982 | Schmitt et al. | 60/690 |
| 4,449,368 | 5/1984 | Haynie | 60/652 |
| 4,643,212 | 2/1987 | Rothrock | 137/1 |
| 4,693,737 | 9/1987 | Tyree, Jr. | 62/384 |
| 4,753,666 | 6/1988 | Pastor et al. | 62/54 |

*Primary Examiner*—Ronald C. Capossela

*Attorney, Agent, or Firm*—Fitch, Even, Tabin & Tabin

[57] ABSTRACT

A method and system for delivering high pressure, subcooled liquid carbon dioxide. An insulated tank having a height greater than its internal diameter holds liquid $CO_2$ to a depth of at least about 6 feet, and high pressure, subcooled liquid $CO_2$ is delivered from a lower outlet of the tank. $CO_2$ vapor is condensed in the upper region to maintain a desired high pressure, e.g., about 290–310 psi., at the top of the tank. By withdrawing liquid $CO_2$ from an upper region in the tank, subcooling it by heat exchange and returning subcooled liquid $CO_2$ to a lower region, a thermocline region is created at least 2 feet below the surface, and above which equilibrium high pressure liquid $CO_2$ exists. Heat exchange is efficiently carried out during off hours using liquid carbon dioxide to chill the condensed refrigerant from an existing auxiliary mechanical refrigeration unit.

15 Claims, 1 Drawing Sheet control

TWO PHASE $CO_2$ STORAGE TANK

This invention relates to cryogenic cooling, and more particularly to systems for supplying liquid carbon dioxide for cryogenic refrigeration purposes.

Liquid carbon dioxide has long been used as a cryogen for commercial refrigeration because of its nontoxicity and desirable range of refrigeration temperatures. Generally, liquid $CO_2$ is stored under about 300 psig pressure and at a temperature of about 0° F. In most applications, it is expanded to atmospheric pressure where it partially turns to a solid, termed $CO_2$ snow or dry ice, with a portion of the liquid flashing to vapor. It is desirable to deliver liquid $CO_2$ at a temperature lower than 0° F. because subcooling of the liquid produces a larger percentage of solid $CO_2$ and a smaller percentage of $CO_2$ vapor, the cooling properties of which vapor are often lost.

It has been difficult to deliver lower temperature $CO_2$ because, in order to reach such lower temperature, it has been generally necessary to employ a lower equilibrium pressure, and of course, lowering the pressure more closely approaches the triple-point pressure and has often proved unsatisfactory because systems for delivering such low temperature $CO_2$ inherently have connections and components where momentary pressure drops can occur. Such pressure drops to below the trile-point will result in the formation of solid $CO_2$ and the gradual buildup of blockages, often requiring shutdown of the system and thus loss in production time in order to clear such blockages. A number of systems have been devised for attempting to overcome such potential difficulties and deliver lower temperature $CO_2$ liquid; examples of such systems are shown in U.S. Pat. Nos. 3,660,985, 3,754,407 and 4,695,302. Although these systems have worked well for particular applications, they have not solved all of the problems, and consequently, still more improvements in this area have been sought.

SUMMARY OF THE INVENTION

The present invention provides a system for delivering liquid $CO_2$ at temperatures of below about −30° F. and at pressures well above the triple-point so that the likelihood of formation of internal solid $CO_2$ blockages as a result of momentary pressure drops is essentially foreclosed. In one aspect, there is provided a system for delivering liquid $CO_2$ either in a subcooled phase or in an equilibrium phase, as desired for a specific application, which liquid is at about the same pressure, e.g., about 300 psig. In another aspect, there is provided an apparatus or system which utilizes a single undivided high pressure liquid $CO_2$ tank or vessel having substantial depth wherein two separate reservoirs of liquid $CO_2$ are maintained in that tank at substantially different temperatures.

In still another aspect, there is provided a system for economically delivering high pressure, lower than equilibrium temperature liquid $CO_2$ by utilizing excess mechanical refrigeration capacity which is normally available, during nighttime and off hours, in the usual industrial plant wherein freezing and/or chilling operations are performed.

DETAILED DESCRIPTION OF THE PREFERRED EMBODIMENTS

Figures 1, 2, 3:
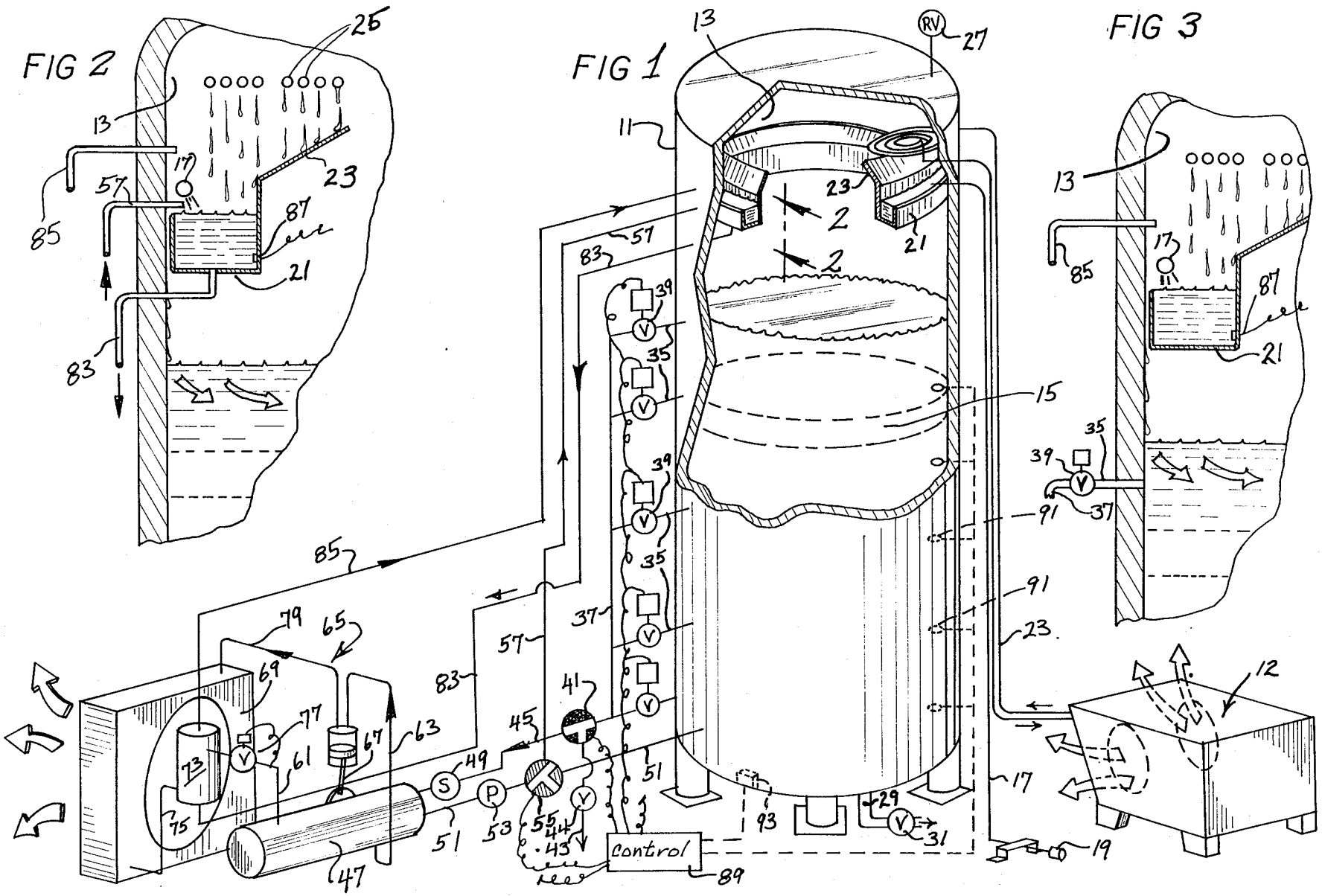
FIG. 1 is a perspective view of a system embodying various features of the invention with portions broken away and with a number of components shown schematically.
FIG. 2 is an enlarged fragmentary sectional view taken very generally along the line 2—2 of FIG. 1.
FIG. 3 is a schematic view of an alternative embodiment of a system to that illustrated in FIG. 1.

Illustrated in FIGS. 1 and 2 is a system for delivering liquid $CO_2$ either at equilibrium conditions, e.g. about 0° F. and 300 psig, or at subcooled conditions, e.g. about −50° F. and 320 psig, equilibrium pressure plus static head pressure. The system includes a vertically oriented tank 11 having a height greater than its interior width and being sized to hold a reservoir of liquid $CO_2$ at least 6 feet in depth; preferably, the tank is at least about 10 feet high, although most preferably the tank is substantially greater in height. Generally, the tank has a height at least about twice its width, and one example of a tank which operates particularly efficiently has a height of about 50 feet and is circular in cross-section with an internal diameter of about 7 feet. The tank 11 is suitably thermally insulated so as to maintain the temperatures therewithin well below ambient temperature. The tank is made from metal which is suitable for holding a cyrogenic liquid at temperatures as low as about −60° F. and at high pressures, for example as high as 350 psig; high nickel alloy steels are often employed.

Very generally, liquid carbon dioxide is supplied to the tank 11 to create a reservoir of liquid $CO_2$ therewithin having a depth of at least about 6 feet; in such a 40-foot high tank, the initial fill may be to a depth of about 35 feet, for example. Following the initial filling of the tank, a reservoir of liquid $CO_2$ will generally be at about equilibrium temperature and pressure conditions therethroughout, for example, about 300 psig and 0° F. A standard freon refrigeration unit 12 is used to maintain the desired equilibrium conditions in the head section 13 at the top of the tank.

Liquid $CO_2$ is withdrawn from the reservoir within the tank, preferably at a location near the upper surface thereof, subcooled to below equilibrium temperature and returned to a location near the bottom of the tank. Continued operation in this fashion creates stratification within the tank resulting in the development of a thermocline region 15 which may have a depth of about 2 or 3 feet. The liquid $CO_2$ above the thermocline remains at substantially equilibrium conditions, whereas the liquid $CO_2$ below the thermocline region is at a substantially lower temperature, preferably at least 20° or 30° F. lower than equilibrium temperature of the liquid $CO_2$ in the upper region. As a result, the tank 11 holds an inventory of high pressure equilibrium liquid $CO_2$ in the upper region, similar to that available from the normal high pressure storage vessel, and an inventory of high pressure subcooled liquid $CO_2$ in the lower region below the thermocline. Liquid $CO_2$ from either or both of these inventories can be delivered to particular $CO_2$-utilizing devices, such as a to carbonation plant or to a cryogenic freezing installation.

More specifically, the system includes a fill line 17 by which liquid $CO_2$ is supplied to the tank 11. The fill line includes a coupling 19 to which a transport truck or railcar can be connected, and it discharges at its upper end at a location just vertically above a receptacle 21 in the form of an open trough of annular shape, the inner wall of which trough carries an annular deflector 23. As best seen in FIG. 2, the outer wall of the annular trough 21 is shorter than the inner wall so that, when the amount of liquid in the trough exceeds its capacity, liquid $CO_2$ overflows the outer wall. Moreover, the outer wall is spaced just slightly apart from the inner wall surface of the tank, preferably a distance of not greater than about 10 millimeters. As a result, the overflowing liquid from the trough 21 flows as a film down the interior surface of the tank to the upper surface of the pool or reservoir of liquid $CO_2$ therebelow. Accordingly, the provision of the trough dissipates the momentum of inflowing make-up liquid $CO_2$ supplied through the fill line 17 and thus prevents such inflow from disrupting an existing thermocline 15 which may exist as high as within about 2 feet from the upper surface of the liquid $CO_2$ reservoir in the tank.

The Freon refrigeration unit 12 includes the usual compressor and condenser, which compress freon vapor and then condenses it to a liquid by dissipating heat to the ambient atmosphere, as generally depicted in FIG. 1; it also includes insulated piping 23 which extends to an evaporator 25, preferably in the form of a coil, located in the head section 13 of the tank. The location of the coil 25 is such that the vapor which condenses falls as droplets into the trough 21 vertically below or onto the deflector 23 leading to the trough 21. As earlier indicated, the freon refrigeration unit 12 is operated so as to maintain a desired equilibrium pressure or temperature by condensing vapor within the head section of the tank. Although vapor could be withdrawn to a side chamber or to an exterior location and condensed there, with the liquid being returned, it is convenient and preferred to locate an evaporator coil 25 or the like in an upper region of the tank 11, preferably above the open trough 21.

As is well known in the art, the temperature or the pressure in the head section 13 of the tank can be monitored, and the refrigeration unit 12 can be operated appropriately so as to maintain the monitored property within the desired range. For example, the pressure may be monitored and maintained between about 290 and about 310 psig. Although a head section pressure as low as about 150 psig might be employed, usually a pressure of at least about 200 psig, and preferably at least about 250 psig and more preferably at least about 290 psig is maintained in the head section of the tank. Likewise, there is no reason why a slightly higher pressure cannot be utilized; however, because the structural materials for making cryogenic tanks get substantially more expensive at higher design operating pressures, and because it is often desirable to be able to deliver liquid $CO_2$ for carbonation purposes or the like at about 300 psig and 0° F., an upper limit of about 305 to 310 psig is generally maintained. The pressure at the bottom of the tank will be the equilibrium pressure plus the pressure of the static liquid head, e.g., often about 20 psi. As in all pressure vessels of this general type, a suitable relief valve 27 is provided so as to appropriately vent $CO_2$ vapor to the atmosphere or the like should the vapor pressure in the head section 13 rise more than an allowable amount above the upper limit pressure which is intended to be maintained by the freon unit 12.

A suitable delivery outlet line 29, through which flow is controlled via a valve 31, is located either in the bottom of the tank 11 or at a location in the sidewall of the tank which is generally near the bottom or which is in communication with a location generally near the bottom of the tank. Located at spaced vertical intervals in the sidewall of the tank 11 are a series of withdrawal pipes 35 which connect to a common withdrawal header 37. Each of the withdrawal pipes 35 includes a solenoid-operated control valve or the like 39. Any desired number of withdrawal pipes 35 can be provided; for example in a tank about 40 feet high, the lowermost withdrawal pipe 35 may be about 6 feet above the bottom with additional withdrawal pipes located at 4 foot intervals thereabove. The withdrawal header 37 connects to a 3-way valve 41 which can be operated to deliver liquid $CO_2$ from the tank to either or both of a delivery line 43 which contains an off-on valve 44 or a line 45 which leads to a main heat exchanger 47 and which may optionally contain a temperature-sensing valve 49. The withdrawn liquid $CO_2$ is subcooled in the main heat exchanger 47, as explained hereinafter, and returned to the tank through a return line 51 which includes a pump 53 and a 3-way valve 55; the return line 51 re-enters the tank 11 near the bottom thereof. The 3-way valve 55 provides optional connection also to a side replenishment line 57 which also leads back to the tank but enters at a location at just above the trough 21, best seen in FIG. 2. The purpose of the side line 57 will be explained hereinafter.

The withdrawn liquid $CO_2$ from the tank flows through the header 37 and the line 45 into the main heat exchanger 47 where it is subcooled, preferably to about −50° F. Although subcooling to even lower temperatures, i.e., about −60° F., is acceptable, it is preferred not to too closely approach the triple point temperature of about −70° F. In general, the efficiency of the overall system is derived from being able to deliver subcooled high pressure liquid $CO_2$, and the economic advantage increases as the temperature of the liquid being delivered decreases. Therefore, the liquid below the thermocline is subcooled at least about 20° F. below its equilibrium temperature and is preferably subcooled to a temperature at least about 40° F. below. This subcooling is effected by heat transfer with a suitable refrigerant which enters the heat exchanger 47 through a entrance line 61 and leaves through an exit line 63.

To supply such refrigerant, a mechanical refrigeration cooling unit 65 is provided which includes a compressor 67 and a condenser 69, which is illustrated as operating against ambient air, although water or any other condensing liquid could be used. An example of the illustrated version is a suitable freon refrigeration unit which utilizes a refrigerant, such as R-12 or R-22 or R-502, which condenses at a temperature between about 80° F. and about 110° F. at some pressure between about 84 and about 245 psig. It should be understood, however, that instead of employing a separate freon unit, if the plant where the system is installed already has a main refrigeration unit having a substantial refrigerant compressing and condensing capability, for example, a large ammonia refrigeration unit, savings in capital costs can be simply achieved by utilizing the existing refrigeration plant during nighttime and during off hours when the unit is either not being used or is being substantially under-utilized. Should such an existing ammonia plant be used to supply condensed refrigerant to the heat exchanger 47, it might also be necessary, depending upon the operating characteristics of the overall system, to supply a booster compressor which would be located at the general location of the compressor 67 in FIG. 1.

Although relatively expensive mechanical refrigeration units 65 can be employed to achieve the desired low temperature cooling for the cold side of the main heat exchanger 47, it has been found that substantial efficiencies and reduced capital cost can be achieved by subcooling the condensate from a freon unit using R-12 or R-22 or R-502 or a similar refrigerant. To effect these efficiencies, a secondary heat exchanger 73 is provided to subcool the condensed refrigerant, i.e., that exiting the ambient air condenser 69, which is routed to the secondary heat exchanger 73 through an inlet line 75. The subcooled refrigerant then exits the secondary heat exchanger 73 through an upper outlet to which is connected the entrance line 61 to the main heat exchanger. This line 61 may contain a valve 77 which senses the downstream pressure in the line 61 and closes automatically if the pressure decreases below a certain level which is indicative of the situation wherein the cold side of the main heat exchanger 47 is flooded with refrigerant and little evaporation is taking place. The vapor created by the evaporating refrigerant on the cold side of the heat exchanger 47 exits via the line 63 flowing to the suction side of the compressor 67 which likewise contains a suitable control device that causes it to shut down if the inlet pressure drops below a certain level. The discharge side of the compressor is connected via the line 79 to the inlet side of the ambient air condenser 69.

To supply the cold side of the secondary heat exchanger 73, a supply line 83 is provided exiting from the bottom of the trough 21 and thus carrying liquid $CO_2$ at about 300 psig and 0° F. to the bottom of the secondary heat exchanger 73. In the secondary heat exchanger, the liquid $CO_2$ absorbs heat from the warmer condensed refrigerant and vaporization occurs, with the $CO_2$ vapor exiting through an upper exit that connects to a line 85 which returns to the tank entering at a location above the open trough 21, as best seen in FIG. 2. The returning vapor is condensed in due course by the freon unit 12, which in normal installations operates only a minor portion of the time and thus can be more efficiently utilized. Accordingly, the cold liquid $CO_2$ in the trough 21 provides a ready supply of cold cooling liquid for the secondary heat exchanger, and even in periods when there is no make-up $CO_2$ being supplied to the tank 11 through the fill line 17, there is generally enough $CO_2$ vapor being condensed by the evaporator coil 25 to assure an adequate supply of liquid $CO_2$ to the line 83. However, to cover the possibility that the level of liquid $CO_2$ in the trough 21 might not be sufficiently replenished by the condensing of $CO_2$ vapor, a liquid level sensor 87 could be provided in the trough 21 that would sense a low level of liquid in the trough and send a signal to a main control unit 89. Upon receipt of such signal, the control unit 89 would operate the 3-way valve 55 so as to pump sufficient liquid $CO_2$ through the replenishment side line 57 to substantially replenish the supply of liquid $CO_2$ in the trough 21.

In addition to receiving the signal from the low liquid level sensor 87, the control unit 89 also is connected to a series of thermocouples 91 which may, for example, be located at 2-foot intervals along the entire height of the tank. As a result of the temperature readings the control unit receives from the vertically spaced thermocouples 91, it can be fairly precisely determined where the thermocline region is located. This information can be used to ascertain the amount of inventory of subcooled $CO_2$ liquid existing in the tank 11 at any time, and depending upon immediate future needs, the rate at which continued subcooling of the liquid is being carried out can be appropriately adjusted.

In addition, the control unit 89 receives a signal from a device 93 for measuring the total depth of liquid $CO_2$ in the tank 11, and this information is utilized in order to determine at what level to most efficiently withdraw the liquid $CO_2$ to be subcooled from the tank. As earlier indicated, the ports into which withdrawal pipes 35 are connected are located at spaced vertical intervals in the sidewall of the tank, and each of these pipes includes a solenoid-operated valve 39 that is appropriately individually electrically connected to the control unit 89. The control unit is programmed so as to open the valve 39 in the withdrawal pipe 35 at the highest vertical level that is below the liquid $CO_2$ surface so that withdrawal of the liquid $CO_2$ farthest from the thermocline region 15 is carried out. In this manner, it is been found that the least disturbance to the thermocline occurs and the most efficient creation of an inventory of high pressure subcooled liquid $CO_2$ is accomplished in the lower region of the tank 11.

As the liquid level in the tank 11 decreases as a result of the delivery of either high pressure subcooled liquid $CO_2$ through the delivery line 29 or of equilibrium liquid $CO_2$ through the delivery line 43, the surface level will drop, and when this level reaches within a few inches of the vertical level of the discharge pipe being used, the control unit 89 will close the valve in this pipe and open the valve in the next lower pipe. The control unit 89 also uses the thermocouple readings to determine when the tank 11 is "fully charged". By comparing the location of the thermocline 15 with the depth of the liquid $CO_2$ in the tank, the control unit can determine how far below the top of the surface the upper boundary of the thermocline is located. When this distance reaches about 2½ feet, for example, the control unit operates the valve 41 to block any further flow of liquid $CO_2$ through the line 45 to be subcooled, and should this distance reach about 2 feet, for example, the valve is operated to block any further flow from the withdrawal header 37. The temperature sensing valve 49 serves as a back-up to this arrangement, and should a decrease in temperature be detected that is indicative that the liquid $CO_2$ in the line 45 is being withdrawn from the thermocline region 15 or from the lower subcooled region, it immediately closes to halt any further subcooling.

In the alternative embodiment depicted in the FIG. 3, the line 83 leading from the bottom of the trough 21 is eliminated, and instead liquid $CO_2$ is supplied to the secondary heat exchanger 73 either from an interconnection at the bottom end of the withdrawal header 37 or via interconnection with the line 45 leading to the main heat exchanger 49. In such an instance, the trough serves only as a momentum disperser, so there is no longer a need to be certain that it contains a minimum depth of liquid $CO_2$; therefore, the 3-way valve 55 and the replenishment line 57 are also eliminated.

Overall, the invention provides a method for inventorying a substantial quantity of high pressure subcooled liquid $CO_2$ in a condition for immediate delivery to an intended use and achieves that objective while simultaneously providing, in a single tank, the capability of also delivering liquid $CO_2$ at equilibrium temperature and pressure. The system, which is designed to facilitate the performance of this method, employs the simple but clever creation of a thermocline region within a tank preferably having a height greater than its width, thereby allowing the creation of two such reservoirs in a single tank. Moreover, an important further advantage is derived from the fact that this dual inventory can be surprisingly stably achieved within a single, undivided tank and can be maintained for relatively long periods of times, thus allowing the delivery of large quantities of high pressure, subcooled liquid $CO_2$ as needed during normal working hours when charges for electricity are usually relatively high while permitting the replenishment of a depleted lower reservoir, from liquid $CO_2$ that is either present in or added to the upper reservoir during off-hour times when electricity costs are relatively low and when an auxiliary mechanical refrigeration unit may be in idle or standby condition and thus available to supply cold side refrigerant at an even further economy.

Although the invention has been described with regard to the preferred embodiments which the inventors believe to constitute the best mode presently known to them for carrying out the invention, changes and modifications as would be obvious to one having the ordinary skill in the refrigeration art can be made to invention without departing from its scope which is defined by the appended claims. For example, a refrigeration coil might be located in a bottom region of the tank wherein an appropriate refrigerant would be circulated to effect the subcooling of liquid $CO_2$ and the creation of a thermocline thereabove.

Particular features of the invention are emphasized in the claims that follow.

What is claimed is:

1. A system for delivering either equilibrium or subcooled liquid carbon dioxide from a single tank, which system comprises an insulated tank for holding liquid $CO_2$ to a depth of at least about 6 feet, inlet means for supplying $CO_2$ to said tank, lower outlet means for delivering liquid $CO_2$ from said tank, means for condensing $CO_2$ vapor, which vapor is present in the head section of said tank, to maintain a desired pressure greater than 150 psig at the top of said tank, heat exchange means, a mechanical refrigeration type cooling unit including a refrigerant compressor and a refrigerant condenser, means for withdrawing equilibrium liquid $CO_2$ from said tank, means for supplying withdrawn equilibrium $CO_2$ to said heat exchange means, means connecting an outlet from said condenser to said heat exchange means so that condensed liquid refrigerant is caused to evaporate and to subcool liquid $CO_2$ in said heat exchange means, vapor return means interconnecting a refrigerant vapor outlet and the suction side of said compressor, and means for returning subcooled liquid $CO_2$ from said heat exchange means to a bottom region of said tank means in a manner in which said returning liquid remains in said bottom region of said tank means, whereby a reservoir of high pressure, subcooled liquid $CO_2$ can be established in said bottom region of said tank means below a thermocline above which an upper region of liquid $CO_2$ can exist which is in equilibrium with $CO_2$ vapor in said head section, said inlet means for supplying $CO_2$ being located to deliver $CO_2$ to the equilibrium region above said thermocline so as not to disrupt such thermocline.

2. A system according to claim 1 wherein means is provided for controlling said upper region condensing means to maintain said top pressure between about 200 psig and about 300 psig.

3. A system for delivering liquid carbon dioxide, which system comprises high pressure insulated tank means for holding liquid $CO_2$ to a depth of at least about 10 feet, upper inlet means for supplying $CO_2$ to said tank means, lower outlet means for delivering liquid $CO_2$ from said tank means, said tank means including upper receptacle means therewithin for holding liquid $CO_2$, means in an upper region within said tank means for condensing $CO_2$ vapor so that said condensed vapor collects in said receptacle means and so that a pressure of at least about 150 psig is maintained, a first heat exchanger, means for withdrawing a first stream of liquid $CO_2$ from said tank means and transferring said withdrawn liquid $CO_2$ to said first heat exchanger, a mechanical refrigeration cooling unit including a refrigerant compressor and a refrigerant condenser, first conduit means connecting an outlet from said condenser to said first heat exchanger so that said condensed liquid refrigerant is caused to flow in heat exchange relationship with said withdrawn liquid $CO_2$ and become subcooled by giving up heat to said liquid $CO_2$, means for returning $CO_2$ from said first heat exchanger to said tank means at a location above said receptacle means, a second heat exchanger, second conduit means connecting a liquid refrigerant outlet from said first heat exchanger to said second heat exchanger wherein said subcooled liquid refrigerant is permitted to expand to vapor, said second heat exchanger having a refrigerant vapor outlet which is connected to the suction side of said compressor, means for withdrawing a second stream of liquid $CO_2$ from said tank means and delivering it to said second heat exchanger means where it flows in subcooling heat exchange with said expanding subcooled refrigerant, and means for returning said subcooled liquid $CO_2$ second stream from said second heat exchanger to a lower region of said tank means, whereby a reservoir of high pressure, subcooled liquid $CO_2$ can be established in a bottom region of said tank means.

4. A system in accordance with claim 3 wherein means is provided for maintaining a pressure of between about 200 and about 300 psig in the head space at the top of said tank means whereby a thermocline forms in the liquid body therein below which subcooled liquid $CO_2$ can exist that is at least about 30° F. cooler than liquid $CO_2$ near the liquid upper surface in said tank means.

5. A system in accordance with claim 4 wherein said mechanical refrigeration unit and said first and second heat exchangers are capable of subcooling liquid $CO_2$ to at least about −40° F.

6. A system in accordance with claim 4 wherein said means for withdrawing liquid $CO_2$ from said tank means includes a plurality of connections to exit ports at different vertical levels, means for measuring the depth of liquid $CO_2$ within said tank means is provided, and control means is provided for selecting said exit port nearest below the upper surface of said liquid to withdraw liquid $CO_2$ therefrom.

7. A system in accordance with claim 3 wherein said mechanical refrigeration system employs a freon refrigerant which condenses at a temperature between about 80° F. and about 110° F. at a pressure between about 84 and about 245 psig.

8. A system in accordance with claim 3 wherein said receptacle means comprises upwardly open trough means and wherein said $CO_2$ vapor condensing means includes evaporation means located vertically above said trough means.

9. A system in accordance with claim 8 wherein said upper inlet means supplies liquid $CO_2$ to said trough means, said trough means is annular and said tank means has a circular cross section, said trough means being designed and located so that said liquid $CO_2$ overflows an outer wall thereof and flows downward along the interior wall of said tank means.

10. A system for delivering liquid carbon dioxide, which system comprises an insulated tank for holding liquid $CO_2$ to a depth of at least about 6 feet and having a head section above the liquid level, upper receptacle means located in said head section above the liquid level, inlet means for supplying liquid $CO_2$ to said upper receptacle means in said tank, lower outlet means for delivering liquid $CO_2$ from said tank, means for condensing $CO_2$ vapor which is present in said head section of said tank to maintain a desired pressure greater than 150 psig therewithin, heat exchange means, a mechanical refrigeration type cooling unit including a refrigerant compressor and a refrigerant condenser, means for withdrawing liquid $CO_2$ from said tank and delivering it to said heat exchange means, means connecting an outlet from said condenser to said heat exchange means so that condensed liquid refrigerant is caused to evaporate and to subcool liquid $CO_2$ in said heat exchange means, vapor return means interconnecting a refrigerant vapor outlet from said heat exchange means and the suction side of said compressor, and means for returning subcooled liquid $CO_2$ from said heat exchange means to a bottom region of said tank means in a manner so that said returning liquid remains in said bottom region of said tank means, whereby a reservoir of high pressure, subcooled liquid $CO_2$ can be established in said bottom region of said tank means below a thermocline above which an upper region of liquid can exist in equilibrium with $CO_2$ vapor in said head section, said liquid $CO_2$ flowing from said upper receptacle means to the upper surface of liquid in said tank without disrupting said thermocline.

11. A system according to claim 10 wherein means is provided for controlling said upper region condensing means to maintain said top pressure between about 200 psig and about 300 psig.

12. A system in accordance with claim 11 wherein said receptacle means comprises upwardly open trough means and wherein said $CO_2$ vapor condensing means includes an evaporator located vertically above said trough means.

13. A system in accordance with claim 12 wherein said upper inlet means supplies liquid $CO_2$ to said trough means, said trough means is annular and said tank means has a circular cross section, said trough means being designed and located so that said liquid $CO_2$ overflows an outer wall thereof and flows downward along the interior wall of said tank means.

14. A system for delivering either equilibrium or subcooled liquid carbon dioxide for an end use from a single tank, which system comprises an insulated tank for holding liquid $CO_2$ to a depth of at least about 6 feet, inlet means for supplying $CO_2$ to said tank, means for condensing $CO_2$ vapor, which vapor is present in the upper region within said tank, to maintain a desired pressure greater than 150 psig at the top of said tank, heat exchange means, a mechanical refrigeration type cooling unit including a refrigerant compressor and a refrigerant condenser, means for withdrawing liquid $CO_2$ from said tank including a plurality of connections to exit ports at different vertical levels, means for measuring the depth of liquid $CO_2$ within said tank means, control means for selecting said exit port nearest below the upper surface of said liquid to withdraw liquid $CO_2$ therefrom, means for delivering the withdrawn liquid $CO_2$ either to said heat exchange means or to an end use, means connecting an outlet from said condenser to said heat exchange means so that condensed liquid refrigerant is caused to evaporate and to subcool liquid $CO_2$ in said heat exchange means, vapor return means interconnecting a refrigerant vapor outlet of said heat exchange means and the suction side of said compressor, means for returning subcooled liquid $CO_2$ from said heat exchange means to a bottom region of said tank means, whereby a reservoir of high pressure, subcooled liquid $CO_2$ can be established in a bottom region of said tank means, and outlet means near the bottom of said tank for delivering subcooled liquid $CO_2$ from said tank to an end use.

15. A system according to claim 14 wherein means is provided for maintaining a pressure of between about 200 and about 300 psig in the head space at the top of said tank means whereby a thermocline forms in the liquid body of $CO_2$ therein below which thermocline subcooled liquid $CO_2$ can exist that is at least about 30° F. cooler than liquid $CO_2$ near the liquid upper surface in said tank means.

* * * * *